US011149990B2

(12) United States Patent
Hu et al.

(10) Patent No.: US 11,149,990 B2
(45) Date of Patent: Oct. 19, 2021

(54) GAS WAVE REFRIGERATOR

(71) Applicant: Dalian University of Technology, Dalian (CN)

(72) Inventors: Dapeng Hu, Dalian (CN); Che Zhu, Dalian (CN); Yuqiang Dai, Dalian (CN); Peiqi Liu, Dalian (CN); Yang Yu, Dalian (CN); Jiupeng Zou, Dalian (CN); Dawei Zhang, Dalian (CN); Runjie Liu, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 380 days.

(21) Appl. No.: 16/178,564

(22) Filed: Nov. 1, 2018

(65) Prior Publication Data

US 2019/0162452 A1 May 30, 2019

(30) Foreign Application Priority Data

Nov. 13, 2017 (CN) ..... 201711111918.3

(51) Int. Cl.

| | |
|---|---|
| ***F25B 9/00*** | (2006.01) |
| ***F25B 13/00*** | (2006.01) |
| ***F25B 25/00*** | (2006.01) |
| ***F25B 1/10*** | (2006.01) |
| ***F25B 9/14*** | (2006.01) |
| ***F25B 41/37*** | (2021.01) |

(52) U.S. Cl.

CPC ..... *F25B 9/00* (2013.01); *F25B 1/10* (2013.01); *F25B 9/145* (2013.01); *F25B 13/00* (2013.01); *F25B 25/005* (2013.01); *F25B 41/37* (2021.01); *F25B 2309/1418* (2013.01); *F25B 2700/1931* (2013.01)

(58) Field of Classification Search

CPC ..... F25B 9/145; F25B 2309/1407; F25B 2309/1413; F25B 2309/1414; F25B 2309/1418; F25B 41/067; F25B 2700/1931

See application file for complete search history.

(56) References Cited

FOREIGN PATENT DOCUMENTS

CN 100575900 C * 12/2009
CN 103868269 A * 6/2014

* cited by examiner

*Primary Examiner* — Brian M King
(74) *Attorney, Agent, or Firm* — Matthias Scholl P.C.; Matthias Scholl

(57) ABSTRACT

A gas wave refrigerator including a first end body; a second end body; a main body disposed between the first end body and the second end body; a first end cover; a hydraulic mandrel; a hydraulic oil inlet pipe; a hydraulic cylinder; a first single mechanical seal; a bushing; a nozzle rotator including two rows of nozzles; press plates disposed at two sides of the nozzle rotator; a main shaft; oscillation receiving tubes; a belt wheel; an embedded bearing seat; a second end cover; and a hydraulic balance device. The hydraulic balance device includes a hydraulic cylinder, a hydraulic mandrel, a seal ring, bearings, a piston, and a piston ring. The nozzle rotator and the press plates disposed at two sides of the nozzle rotator are installed on the main shaft.

2 Claims, 10 Drawing Sheets

GAS WAVE REFRIGERATOR

CROSS-REFERENCE TO RELATED APPLICATIONS

Pursuant to 35 U.S.C. § 119 and the Paris Convention Treaty, this application claims foreign priority to Chinese Patent Application No. 201711111918.3 filed Nov. 13, 2017, the contents of which and any intervening amendments thereto are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND

This disclosure relates to a gas wave refrigerator (GWR), which is a device that refrigerates a medium by shock waves or expansion waves generated by gas pressure energy.

Conventional gas wave refrigerators include a plurality of rotational components and sealing elements, so they have complex structures and are difficult to assemble and disassemble.

SUMMARY

In view of the above-described problems, it is one objective of the invention to provide a hydraulic balance type gas wave refrigerator.

The gas wave refrigerator comprises a two-row-nozzle rotator and two rows of oscillation receiving tubes.

The gas wave refrigerator comprises a first end body; a second end body; a main body disposed between the first end body and the second end body; a first end cover; a hydraulic mandrel; a hydraulic oil inlet pipe; a hydraulic cylinder; a first single mechanical seal; a bushing; a nozzle rotator comprising a first row of nozzles and a second row of nozzles; press plates disposed at two sides of the nozzle rotator; a main shaft; oscillation receiving tubes; a belt wheel; an embedded bearing seat; a second end cover; and a hydraulic balance device, the hydraulic balance device comprising a hydraulic cylinder, a hydraulic mandrel, a seal ring, bearings, a piston, and a piston ring.

The outer walls of the first end body, the main body, and the second end body form a shell of the gas wave refrigerator; the main shaft is disposed in the main body and comprises a first half shaft which is solid and a second half shaft which is hollow; the nozzle rotator is in a cylindrical shape; the nozzle rotator and the press plates disposed at two sides of the nozzle rotator are installed on the main shaft; the nozzle rotator is sandwiched by the two press plates; the first row of nozzles and the second row of nozzles are disposed circumferentially on the lateral surface of the nozzle rotator; nozzle exits of the first row of nozzles are aligned with or staggered from nozzle exits of the second row of nozzles at an axial direction of the nozzle rotator; the oscillation receiving tubes are disposed on the main body in two rows corresponding to the first row of nozzles and the second row of nozzles, respectively; when in use, the nozzle rotator rotates synchronously along with the main shaft, and continuously sprays gas through the first row of nozzles and the second row of nozzles into corresponding row of the oscillation receiving tubes; the raw gas enters the hollow half shaft of the main shaft via a gas inlet pipe and the second end cover, and is sprayed outwards via the nozzle exits of the nozzle rotator; an inlet of the hollow half shaft of the main shaft is provided with a second single mechanical seal; the hydraulic balance device is disposed at one end of the first half shaft of the main shaft; the piston and the piston ring are disposed between the first bearings; the hydraulic mandrel is disposed in the hydraulic cylinder and is supported by the first bearings; the hydraulic mandrel butts against the center of the solid half shaft of the main shaft; the hydraulic cylinder is embedded in one end of the first end body, and is sealed by the first end cover; the nozzle rotator, the exhaust pipes, and the belt wheel adopt radial labyrinth seals; the radial labyrinth seals are formed by a movable seal ring, a static seal ring, and a first O-shaped ring; the movable seal ring is fixed on the main shaft; an outer circle of the static seal ring sleeves the main body; and the first O-shaped ring is disposed between the movable seal ring and the static seal ring; a second single mechanical seal is disposed between the gas inlet pipe and the belt wheel; the second bearings are arranged at two ends of the main shaft, respectively; bearing boxes are arranged on two ends of the gas wave refrigerator, respectively; one bearing box is disposed in the first end body, and the other bearing box is in the form of an embedded bearing seat in the second end body; bidirectional spiral seals are arranged on the main shaft between the second bearings and the gas path system; a first single mechanical seal is arranged on the main shaft close to the gas outlet; one end of the first single mechanical seal is provided with a seal cover; the circumference of the outer circle of the shell of the gas wave refrigerator is provided with three screw holes in one plane, the included angles between each two of which are 120°; and the seal cover is fixed by three tapered threaded bolts corresponding to the three screw holes.

The nozzle exits of the nozzle rotator can be circular, square, or rectangular, and can be between 1 and 9 in number; the nozzle exits of the nozzle rotator can communicate with pipe holes of the oscillation receiving tubes on the main body; each row of the nozzles can communicate with 20-130 oscillation receiving tubes, and the tail of each oscillation receiving tube can be connected to one shock absorption cavity; the main body can comprise one gas inlet pipe and one to ten exhaust pipes, and the exhaust pipes can be arranged on two sides of the nozzle rotator; the diameters of the pipe holes matching the nozzle rotator on the main body can be between 5 and 55 mm; the deflection angles of the pipe holes can be between 0 and 25 degrees; and the lengths of the oscillation receiving tubes fixed on the pipe holes can be between 1500 and 12000 mm.

Advantages of the gas wave refrigerator in the disclosure are summarized as follows:

1. The axial force is balanced by the hydraulic balance device, which prolongs the service life of the gas wave refrigerator.
2. The hydraulic balance device, the bearings, and the single mechanical seals can share one machine oil circulating system, simplifying the structure of the machine.
3. The main shaft is integrated with the spiral seals, reducing the assembly steps.
4. The gas wave refrigerator includes mechanical seals which exhibit improved sealing efficiency.
5. The embedded bearing seat and the hydraulic cylinder are arranged on two ends of the machine body, which facilitates the disassembly and replacement of the gas wave refrigerator.

Figure 1:
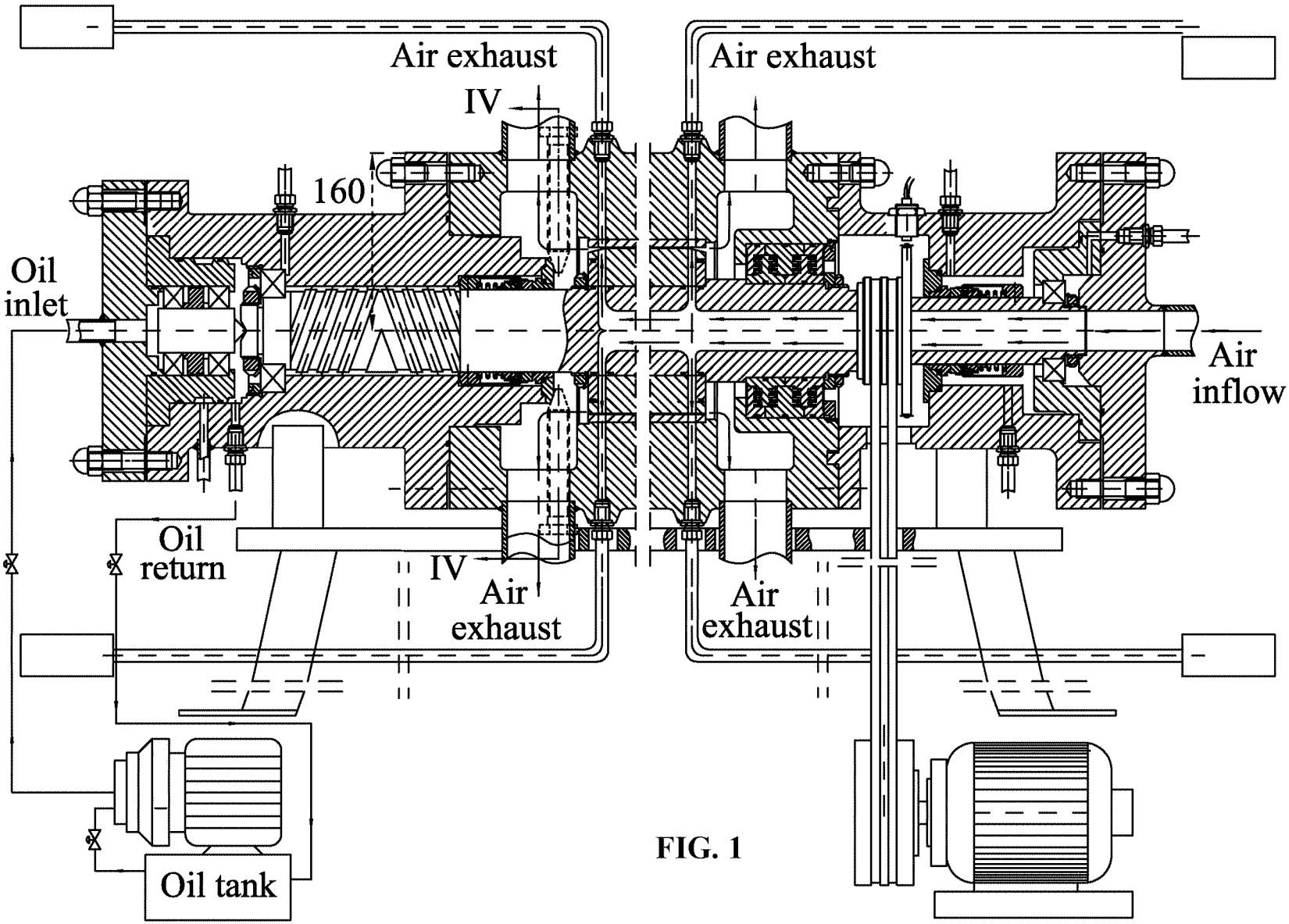
FIG. 1 is a schematic diagram of a gas wave refrigerator as described in the disclosure.

In the drawings, the following reference numbers are used: 1, first end body; 2, first end cover; 3, hydraulic mandrel; 4, hydraulic oil inlet pipe; 5, hydraulic cylinder; 6, first O-shaped seal ring; 7, first bearing; 8, piston; 9, piston ring; 10, inner compression nut; 11, outer compression cap; 12, second bearing; 13, first movable joint; 14, first double-end stud; 15, second O-shaped seal ring; 16, main body; 17, first single mechanical seal; 18, baffle plate; 19, nozzle rotator; 20, bushing; 21, press plate; 22, main shaft; 22*a*, bidirectional spiral seal; 23, movable seal ring; 24, static seal ring; 25, first O-shaped ring; 26, exhaust pipe; 27, first compression nut; 28, oscillation receiving tube; 29, belt wheel; 30, belt; 31, speed measuring sensor; 32, disc cover; 33, second movable joint; 34, second single mechanical seal; 35, second end body; 36, third bearing; 37, second compression nut; 38, embedded bearing seat; 39, third O-shaped seal ring; 40, second end cover; 41, second double-end stud; 42, shock absorption cavity; 43, third movable joint; 44, gas inlet pipe; 45, motor; 46, pipe joint; 47, second O-shaped ring; 48, threaded bolt; 49, oil pump; and 50, oil tank.

DETAILED DESCRIPTION

To further illustrate, embodiments detailing a gas wave refrigerator are described below. It should be noted that the following embodiments are intended to describe and not to limit the description.

Figure 2:
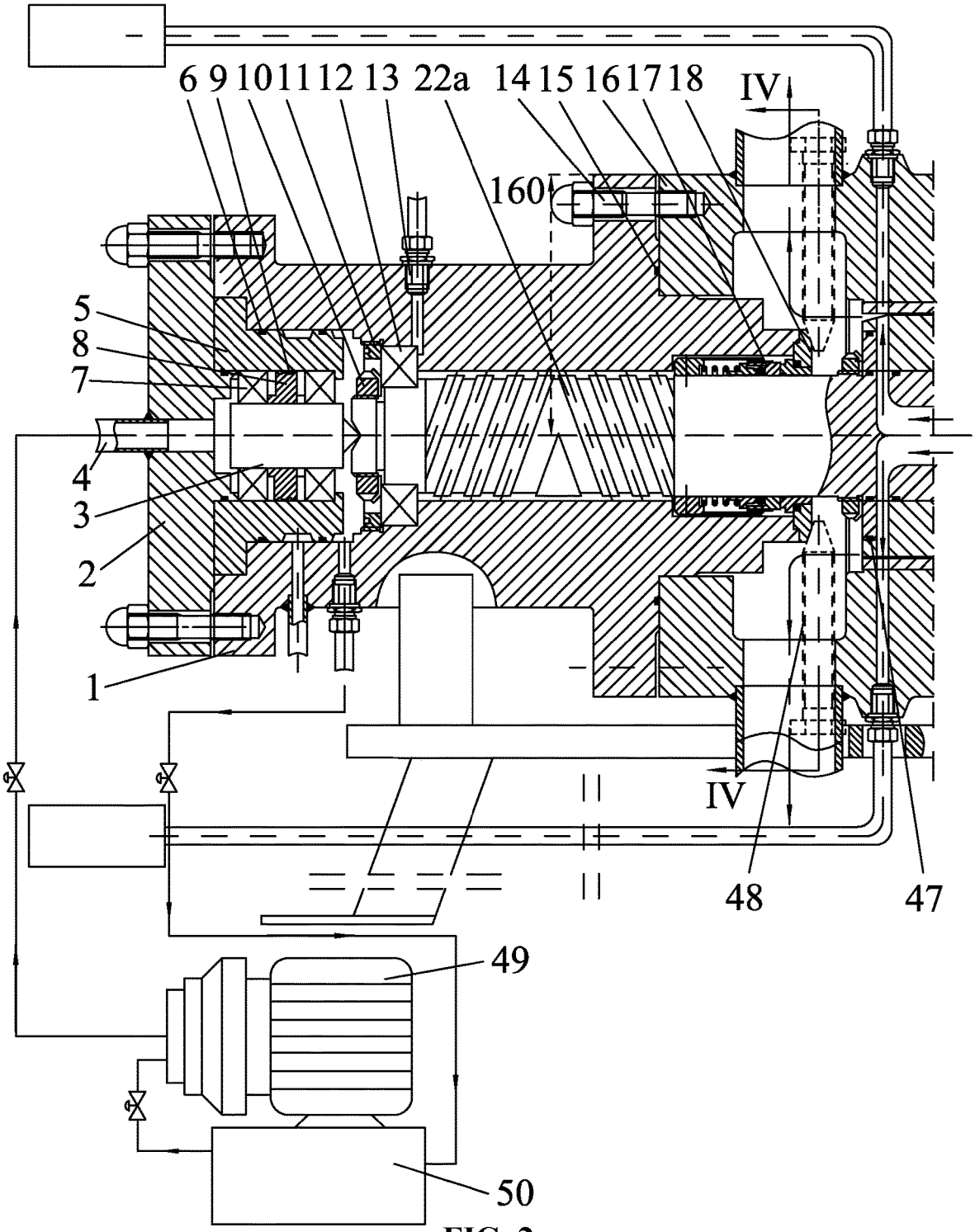
FIG. 2 is a schematic diagram of a first end body of a gas wave refrigerator as described in the disclosure.
Figure 3:
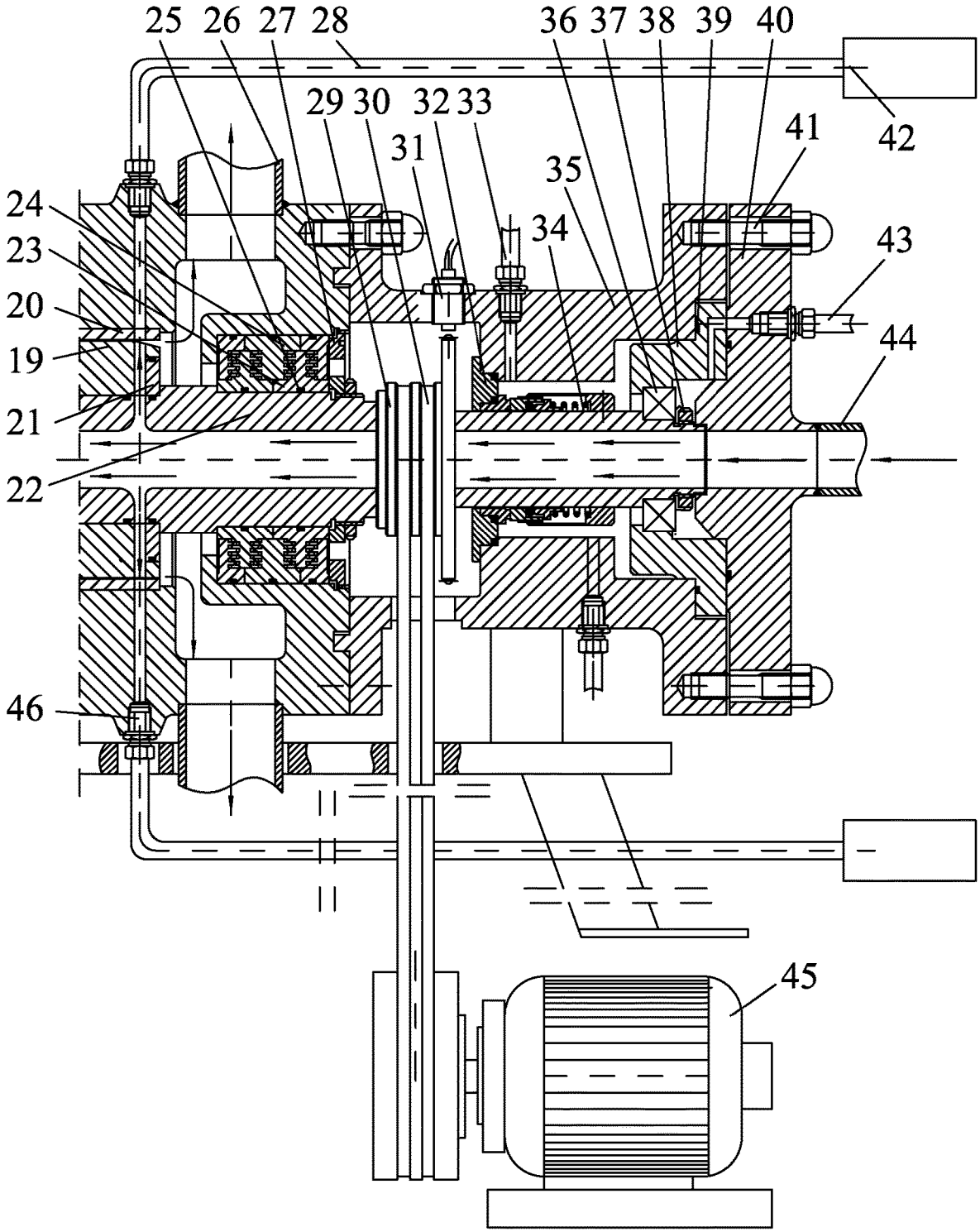
FIG. 3 is a schematic diagram of a second end body of a gas wave refrigerator as described in the disclosure.
Figure 4:
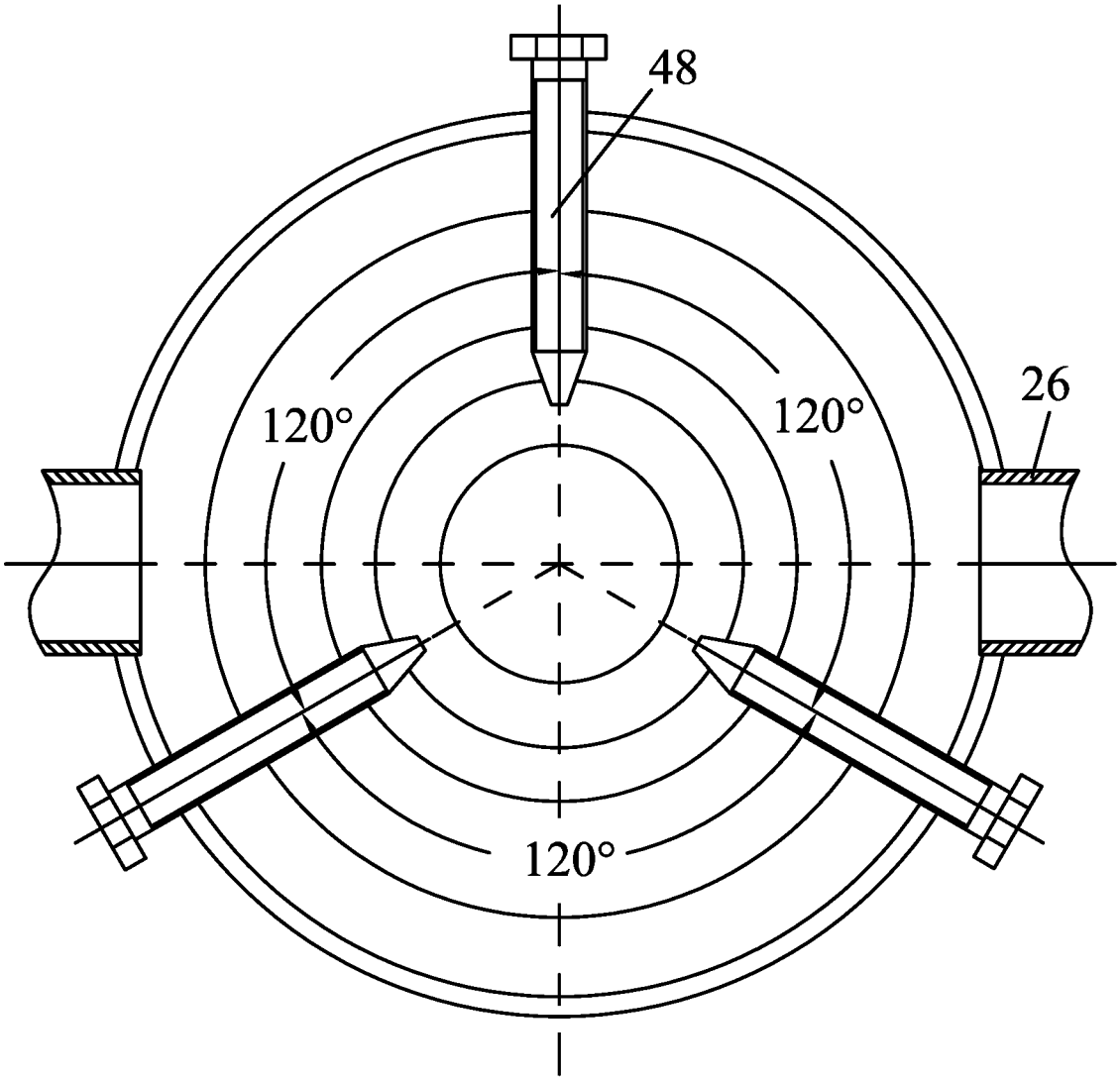
FIG. 4 is a sectional view taken from line IV-IV in FIG. 1.

FIGS. 1-4 illustrate a gas wave refrigerator comprising a first end body 1, a first end cover 2, a hydraulic mandrel 3, a hydraulic oil inlet pipe 4, a hydraulic cylinder 5, a main body 16, a first single mechanical seal 17, a nozzle rotator 19, a bushing 20, press plates 21 disposed at two sides of the nozzle rotator 19, a main shaft 22, oscillation receiving tubes 28, a belt wheel 29, a second end body 35, an embedded bearing seat 38, a second end cover 40. The gas wave refrigerator is of a horizontal structure. The main body 16 is deposed between the first end body 1 and the second end body 35. The second end body 35 comprises a speed measuring sensor 31. The outer walls of the first end body 1, the main body 16, and the second end body 35 form the shell of the gas wave refrigerator. The shell plus the first end cover 2 and the second end cover 40 form the entire housing of the gas wave refrigerator. The main shaft 22 is disposed in the main body and comprises a first half shaft which is solid and a second half shaft which is hollow. The nozzle rotator 19 and the press plates 21 disposed at two sides of the nozzle rotator 19 are installed on the main shaft 22. Each nozzle rotator 19 is sandwiched by two press plates 21. The nozzle exits of the first row of nozzles on the nozzle rotator are aligned with or staggered from nozzle exits of the second row of nozzles at an axial direction of the nozzle rotator. When in use, the nozzle rotator 19 rotates synchronously along with the main shaft 22, and continuously sprays gas into corresponding double row oscillation receiving tubes 28. The raw gas enters the hollow half shaft of the main shaft 22 via a gas inlet pipe 44 and the second end cover 40, and then is sprayed outwards via the nozzle exits of the nozzle rotator 19. Thus, the gas is distributed around along with the rotation of the nozzles. The main shaft 22 is equipped with different seal parts as needed. The inlet of the hollow half shaft of the main shaft 22 is provided with a second single mechanical seal 34. In this disclosure, the gas enters the machine in the axial direction, so that the second bearings 12 are subject to the vast majority of stress, which adversely affects the service life of the bearings. To solve the problem, in this embodiment, a hydraulic balance force is exerted on the solid half shaft of the main shaft to counteract the axial force. Specifically, a hydraulic balance device is disposed close to the first half shaft of the main shaft 22. The hydraulic balance device comprises a hydraulic cylinder 5, a hydraulic mandrel 3, a seal ring 6, first bearings 7, a piston 8, and a piston ring 9. The piston 8 and the piston ring 9 are disposed between the first bearings 7. The hydraulic mandrel 3 is disposed in the hydraulic cylinder 5 and is supported by the first bearings 7. The top of the hydraulic mandrel 3 butts against the center of the solid half shaft of the main shaft 22. The hydraulic cylinder 5 as a component is embedded into one end of the first end body 1, and then is sealed by the first end cover 2. The hydraulic oil stored in an oil tank 50 is pumped into the hydraulic balance device via the oil pump 49, so that the piston produces a pushing force to the other end. The pushing force and the axial force are opposite in directions and counteract with each other.

The belt wheel and speed measuring gears are arranged in the middle of the main shaft, and the motor 45 is disposed in the middle of the gas wave refrigerator and drives the main shaft to rotate via the belt 30 and the belt wheel. To prevent the gas leakage, two sides of the belt wheel should be sealed. Specifically, the nozzle rotator 19, the exhaust pipes 26, and the belt wheel 29 adopt radial labyrinth seals; the radial labyrinth seals are formed by a movable seal ring 23, a static seal ring 24, and a first O-shaped ring 25; the movable seal ring 23 is fixed on the main shaft 22; an outer circle of the static seal ring 24 sleeves the main body 16; and the first O-shaped ring 25 is disposed between the movable seal ring 23 and the static seal ring 24. The two second bearings 12, serving as the support of the main shaft 22 inside the machine body, are arranged at two ends of the main shaft, respectively, and are fixed by an outer compression cap 11 and an inner compression nut 10. To facilitate the replacement of the second bearings, the bearing boxes are arranged on two ends of the gas wave refrigerator, respectively. One bearing box is disposed in the first end body 1, and the other bearing box is in the form of an embedded bearing seat 38 in the second end body. The machine oil of the hydraulic balance device in the first end body can lubricate the second bearings. To prevent the machine oil from flowing into the gas path system, bidirectional spiral seals 22*a* are arranged on the main shaft between the second bearings and the gas path system. In the rotating process of the main shaft 22, the spiral seals are capable of pushing the liquid phase machine oil and the gas phase working medium towards two sides. In addition, a first single mechanical seal 17 is arranged on the main shaft close to the gas outlet. One end of the first single mechanical seal is provided with a seal cover. The circumference of the outer circle of the shell of the gas wave refrigerator is provided with three screw holes in one plane, the included angles between each two of which are 120°. The seal cover is fixed by three tapered threaded bolts 48 corresponding to the three screw holes.

The hydraulic oil inlet pipe 4 is an oil input pipe of the hydraulic balance device and is soldered on the first end cover 2. The hydraulic oil inlet pipe 4 is connected to the first end body 1 via a first movable joint 13. The first end body 1 is connected to the main body 16 via a first double-end stud 14. The second O-shaped seal ring 15 is disposed between the first end body 1 and the main body 16. The bushing 20 is a transition piece of the main body 16 and the nozzle rotator 19.

The second end body 35 comprises a second movable joint 33. A second compression nut 37 is provided to tighten the nut of the third bearings 36 of the second end body. The third O-shaped seal ring 39 is embedded between the embedded bearing seat 38 in the second end body and the second end body 35. The second double-end stud 41 is a fastening bolt between the second end cover 40 and the second end body 35. The third movable joint 43 is an oil injection joint of the third bearings 36. The pipe joint 46 is a connection joint of the main body 16 and the oscillation receiving tubes 28. The second O-shaped ring 47 is a seal ring between the press plate 21 and the nozzle rotator 19.

Figure 5:
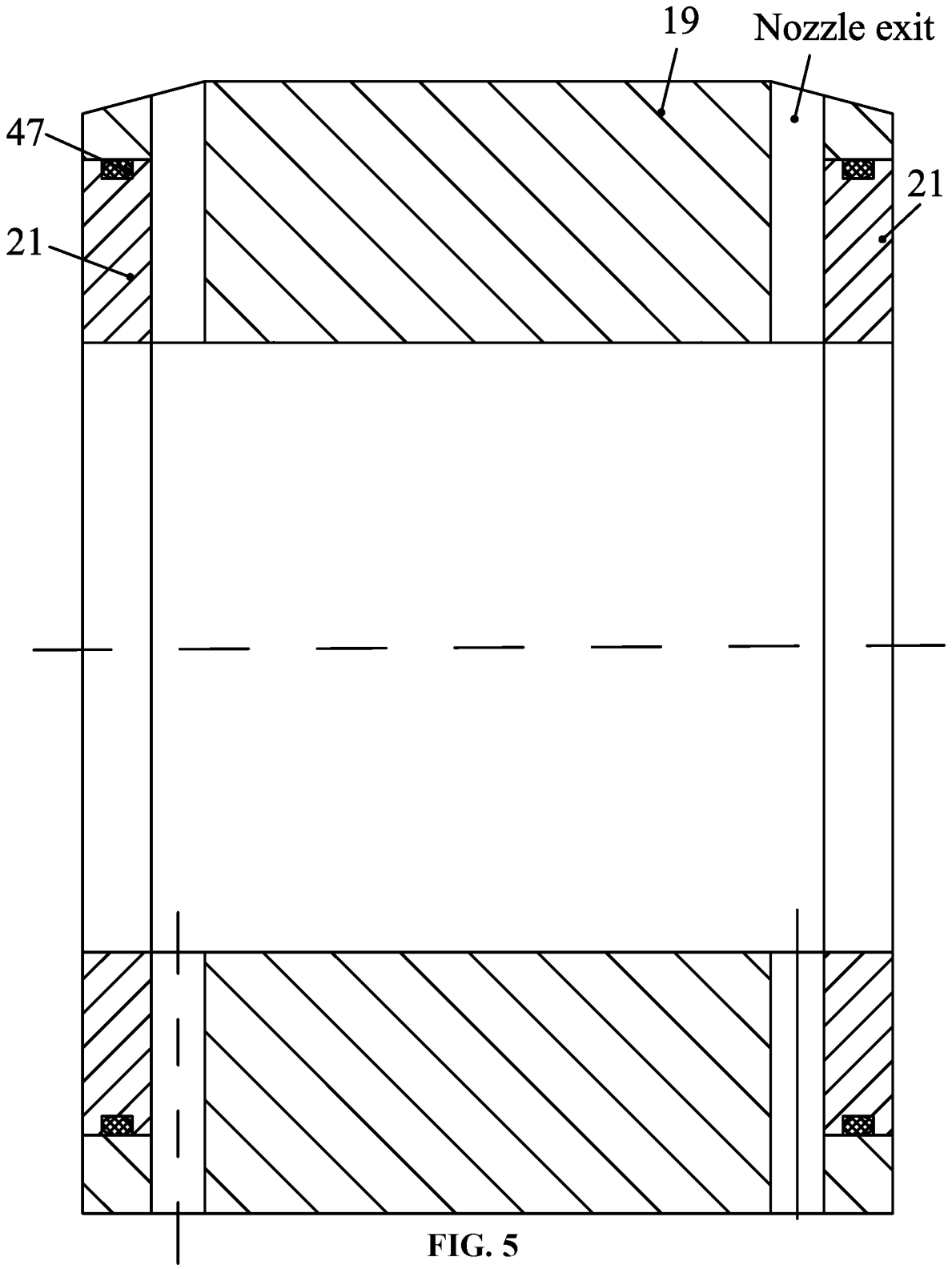
FIG. 5 is a schematic diagram of a nozzle rotator of a gas wave refrigerator as described in the disclosure.
Figure 6:
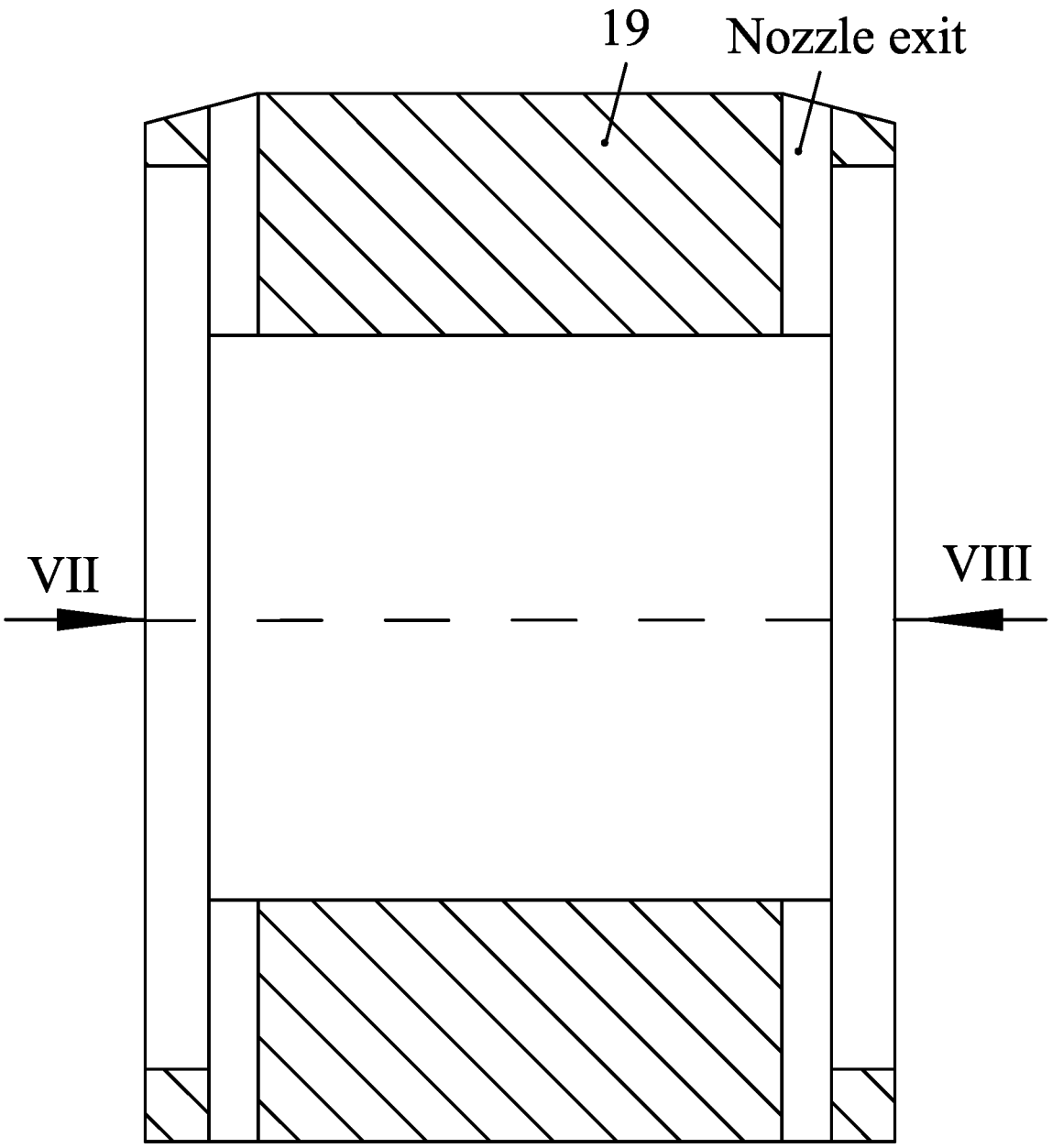
FIG. 6 is a front view of a nozzle rotator as described in the disclosure.
Figure 7:
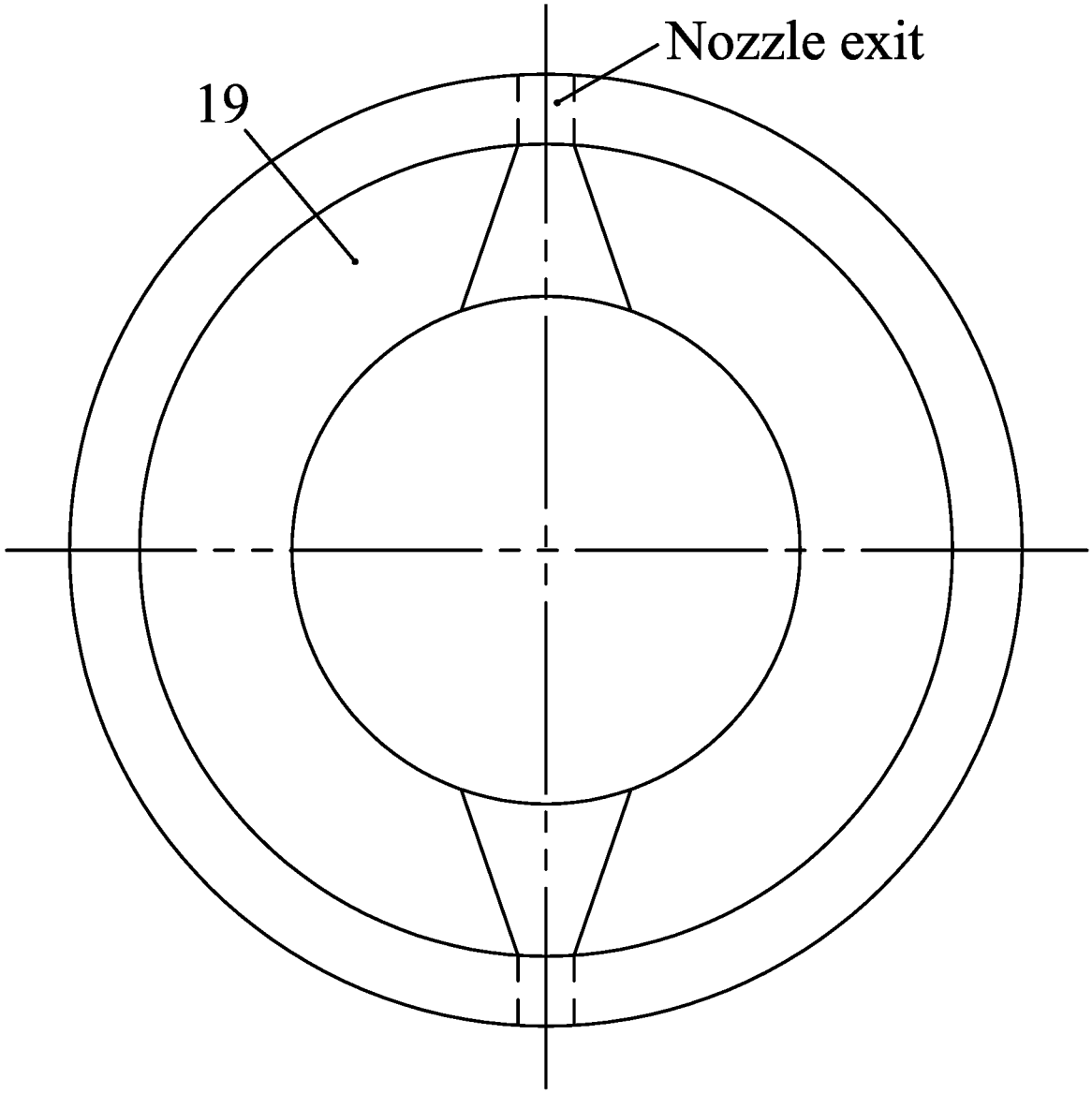
FIG. 7 is a sectional view taken from arrow VII in FIG. 6.
Figure 8:
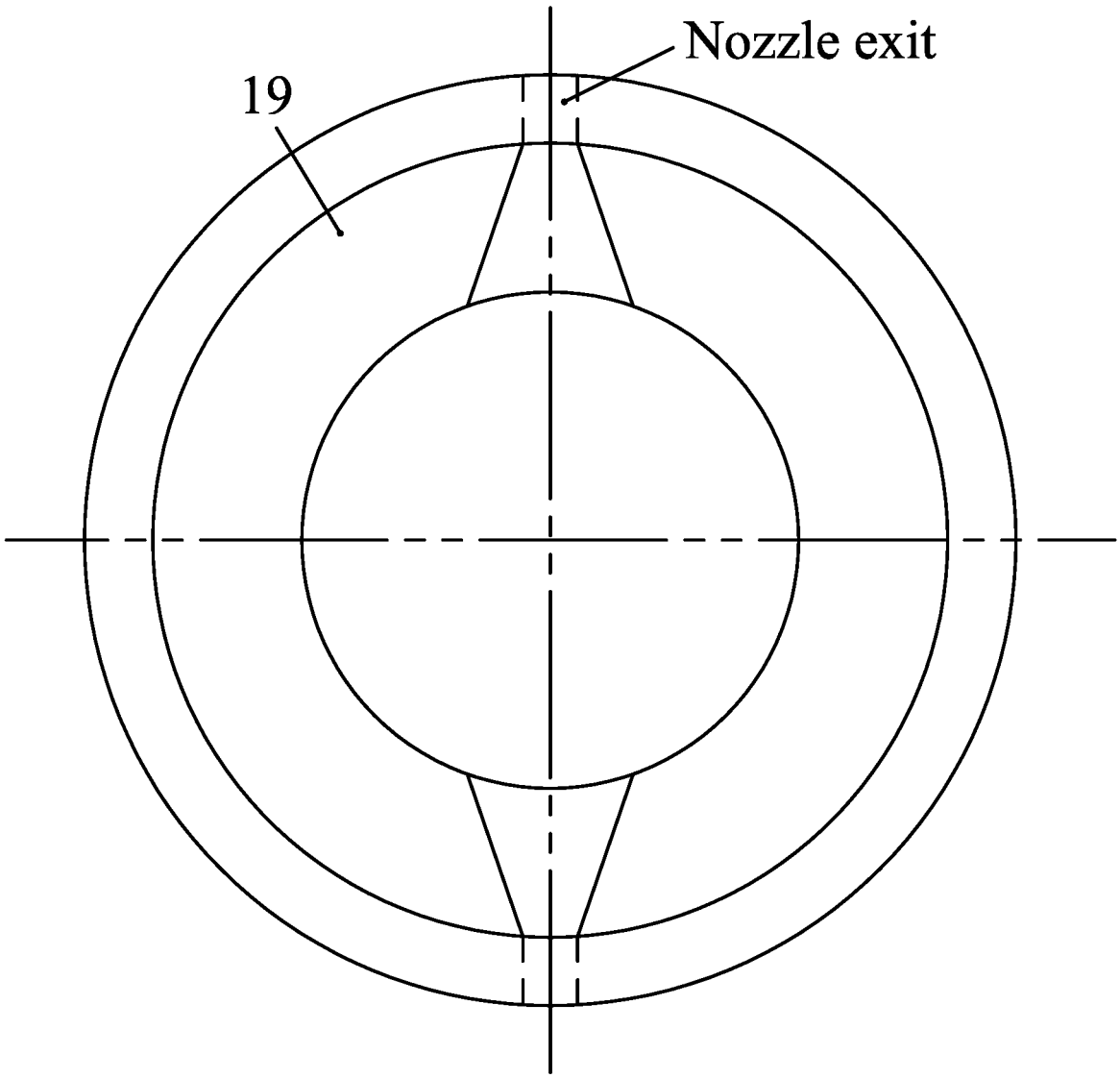
FIG. 8 is a sectional view taken from arrow VIII in FIG. 6.
Figure 9:
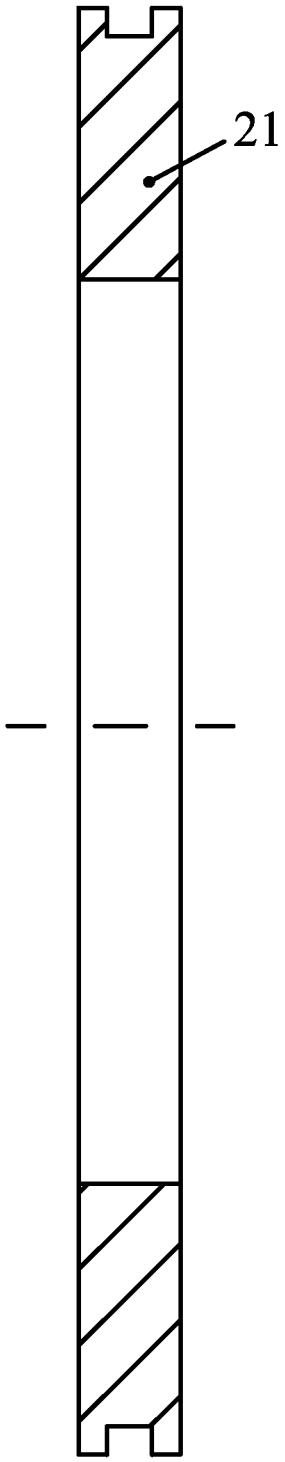
FIG. 9 is a front view of a press plate of a nozzle rotator as described in the disclosure.
Figure 10:
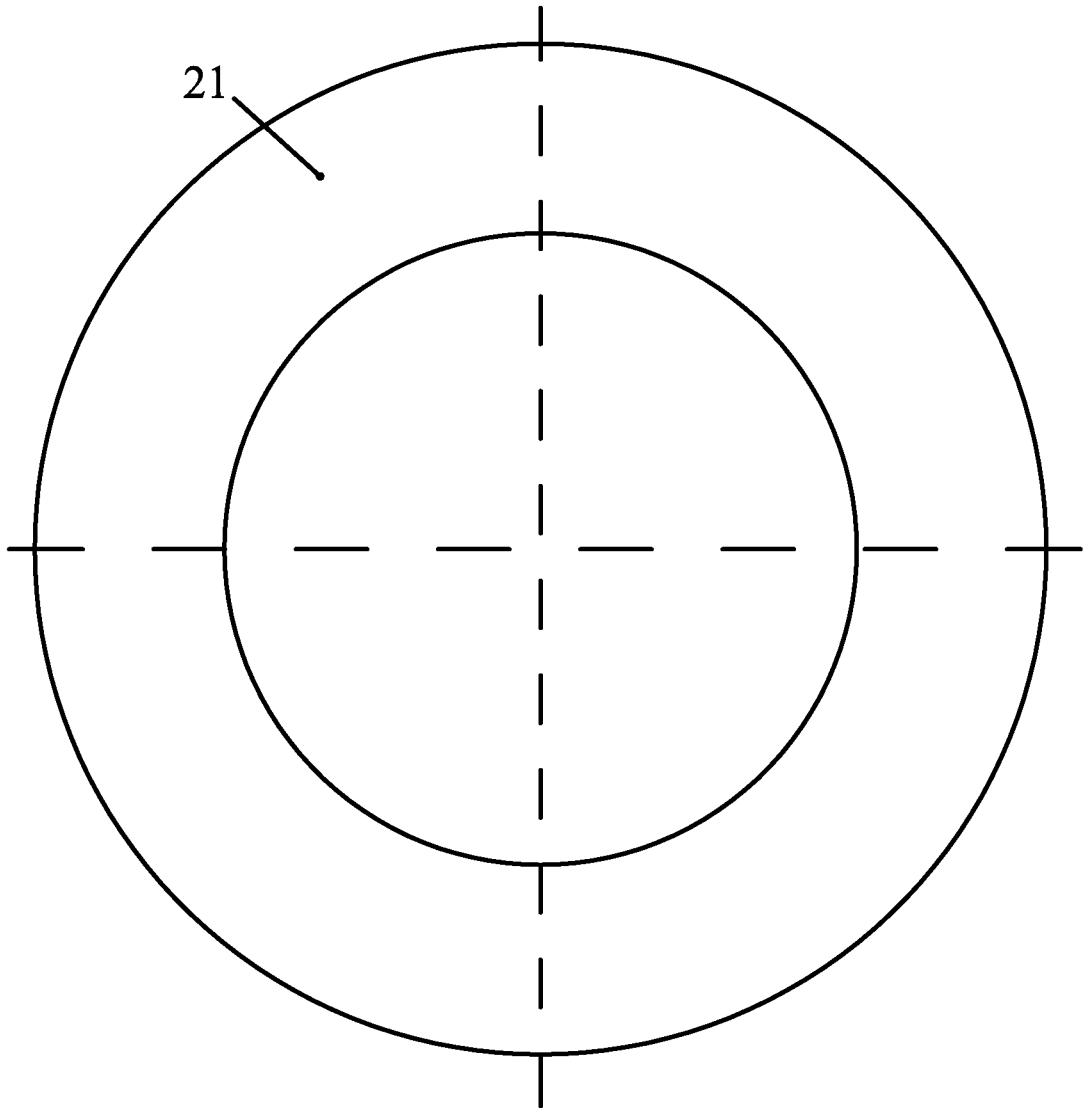
FIG. 10 is a side view of a press plate of a nozzle rotator as described in the disclosure.

FIGS. 5-10 illustrate structural drawings of the nozzle rotator of the gas wave refrigerator. The nozzle exits of the nozzle rotator 19 are circular, square, or rectangular, and are between 1 and 9 in number. The nozzle exits of the nozzle rotator communicate with pipe holes of the oscillation receiving tubes on the main body. Each row of the nozzles communicates with 20-130 oscillation receiving tubes, and the tail of each oscillation receiving tube is connected to one shock absorption cavity 42. The main body comprises one gas inlet pipe and one to ten exhaust pipes 26, and the exhaust pipes are arranged on two sides of the nozzle rotator 19. The diameters of the pipe holes matching the nozzle rotator 19 on the main body 16 are 5 to 55 mm, the deflection angles of the pipe holes are 0 to 25 degrees, and the lengths of the oscillation receiving tubes fixedly connected onto the pipe holes are 1500 to 12000 mm.

The working principle of the oscillation receiving tubes are summarized as follows: in operation, when the gas is injected into the oscillation receiving tubes, compression waves, shock waves, expansion waves, and reflection shock waves will be generated and move in the tubes constantly. The movement of the waves in each pipe is the same. The gas in the tube is exhausted outward during two injection intervals. The movement of the compression wave and shock wave in the tube increases the temperature of the gas in the tube. The heat is dissipated through the tube wall and the produced expansion wave cools the gas. This is because the pressure gas does work through expansion and reduces the energy, thus cooling down itself.

The entire cooling process is described as follows:

(1) Injection stage: when a high-speed gas is injected into the oscillating receiving tube, a contact surface is formed between the injected fresh gas and the original stagnant gas in the tube. The contact surface can be regarded as a "piston" without mass. Since the speed and pressure are not equal on both sides of the contact surface, to meet the compatibility conditions of the contact surface (i.e., the speed and pressure of the gases on both sides of the contact surface must be equal), the forward movement of the "piston" means that the compression wave is continuously pushed forward, a shock wave will appear in front of the "piston" and moves in the same direction as that of the "piston." The shock wave is the result of the compression wave superposition.

(2) Heat release stage: with the generation and flowing of the shock wave, the gas is continuously compressed, and the temperature and pressure are increased. After a plurality of cycles, the temperature of the gas in the oscillation receiving tube is gradually increased, and heat is dissipated through the tube wall, thus completing the energy conversion. Since the injected gas does work on the gas in the tube through expansion, according to the first law of thermodynamics, the total temperature of the injected gas decreases.

(3) Exhaust stage: when the rotating nozzles are turned away from the oscillating receiving tube, that is, the nozzle stops injecting gas into the tube, the pressure inside the tube is greater than the pressure outside the tube, the gas in the tube flows out of the nozzle in reverse direction and expands again to produce cooling capacity. The cooling capacity is collected and discharged from the machine, completing a refrigeration cycle.

Since the gas wave in each of the oscillation receiving tubes finally reaches the closed end of the tube, when the injected gas encounters the solid wall, a reflected shock wave is inevitably generated, and once the reflected shock wave returns to the inlet end of the receiving tube, it is highly probable that the already cooled gas will be reheated, which will greatly reduce the refrigeration efficiency of the refrigerator. To solve the problem, the tail of each oscillation receiving tube is provided with one shock absorption cavity.

It will be obvious to those skilled in the art that changes and modifications may be made, and therefore, the aim in the appended claims is to cover all such changes and modifications.

What is claimed is:

1. A gas wave refrigerator, comprising:

a first end body;

a second end body;

a main body disposed between the first end body and the second end body;

a first end cover;

a first single mechanical seal;

a nozzle rotator, the nozzle rotator comprising first nozzle exits and second nozzle exits;

two press plates;

a main shaft, the main shaft comprising a shaft axis, a first end, and a second end; the second end comprising a channel;

first oscillation receiving tubes and second oscillation receiving tubes:

a belt wheel;

two bearing boxes;

a second end cover;

exhaust pipes;

a gas inlet pipe;

second bearings; and a hydraulic balance device, the hydraulic balance device comprising a hydraulic cylinder, a hydraulic mandrel, first bearings, a piston, and a piston ring; wherein:

outer walls of the first end body, the main body, and the second end body form a shell of the gas wave refrigerator;

the main shaft is disposed in the main body;

the nozzle rotator is in a cylindrical shape;

the first nozzle exits are disposed circumferentially at a first lateral surface of the nozzle rotator, and the second nozzle exits are disposed circumferentially at a second lateral surface of the nozzle rotator; wherein the first lateral surface and the second lateral surface are perpendicular to the shaft axis;

the two press plates are respectively disposed at a top surface and a bottom surface of the nozzle rotator;

the two press plates and the nozzle rotator are installed on the main shaft;

the channel of the second end is connected to the first nozzle exits and the second nozzle exits;

the first oscillation receiving tubes and the second oscillation receiving tubes are disposed on the main body; and the first oscillation receiving tubes and the second oscillation receiving tubes are connected to the first nozzle exits and the second nozzle exits, respectively;

the hydraulic mandrel is disposed in the hydraulic cylinder and is supported by the first bearings;

the hydraulic mandrel abuts against a center of the first end of the main shaft;

the hydraulic cylinder is embedded in one end of the first end body, and is sealed by the first end cover;

the piston and the piston ring are disposed between the first bearings;

the second end body is connected to the second end cover;

the exhaust pipes are arranged at two sides of the nozzle rotator;

the belt wheel is arranged in a middle of the main shaft;

the gas inlet pipe is connected to the main shaft;

labyrinth seals are provided between the nozzle rotator and the exhaust pipes;

a second single mechanical seal is disposed between the gas inlet pipe and the belt wheel;

the second bearings are arranged at two ends of the main shaft, respectively;

the two bearing boxes are arranged on two ends of the gas wave refrigerator, respectively;

one of the two bearing boxes is disposed in the first end body, and the other one of the two bearing boxes is in the form of an embedded bearing seat in the second end body;

bidirectional spiral seals are arranged on the main shaft;

the first single mechanical seal is arranged on the main shaft;

one end of the first single mechanical seal is provided with a seal cover;

a circumference of an outer circle of the shell of the gas wave refrigerator is provided with three screw holes;

an included angle between each two adjacent ones of the screw holes is 120°; and the seal cover is fixed by three tapered threaded bolts to the three screw holes, respectively; and when in use:

gas enters the channel of the second end of the main shaft via the gas inlet pipe and the second end cover; and the nozzle rotator rotates synchronously along with the main shaft around the shaft axis, and sprays the gas through the first nozzle exits and the second nozzle exits into the first oscillation receiving tubes and the second oscillation receiving tubes.

2. The refrigerator of claim 1, wherein:

the first nozzle exits and the second nozzle exits are circular, square, or rectangular, and are between 1 and 9 in number;

the first nozzle exits and the second nozzle exits are connected to pipe holes of the first oscillation receiving tubes and the second oscillation receiving tubes, respectively;

a tail of each oscillation receiving tube is connected to one shock absorption cavity;

diameters of the pipe holes are between 5 and 55 mm;

deflection angles of the pipe holes are between 0 and 25 degrees; and lengths of the first oscillation receiving tubes and the second oscillation receiving tubes are between 1500 and 12000 mm.

* * * * *